US011331935B2

(12) United States Patent
Hada et al.

(10) Patent No.: US 11,331,935 B2
(45) Date of Patent: May 17, 2022

(54) LIQUID DISCHARGE APPARATUS HAVING INDIVIDUALLY CONTROLLED IRRADIATORS AND CONTROL METHOD

(71) Applicants: Atsushi Hada, Tokyo (JP); Daisuke Mezaki, Kanagawa (JP)

(72) Inventors: Atsushi Hada, Tokyo (JP); Daisuke Mezaki, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/971,440

(22) PCT Filed: Mar. 25, 2019

(86) PCT No.: PCT/JP2019/012424
§ 371 (c)(1),
(2) Date: Aug. 20, 2020

(87) PCT Pub. No.: WO2019/188945
PCT Pub. Date: Oct. 3, 2019

(65) Prior Publication Data

US 2020/0398589 A1 Dec. 24, 2020

(30) Foreign Application Priority Data

Mar. 30, 2018 (JP) ..... JP2018-070224
Feb. 1, 2019 (JP) ..... JP2019-017354

(51) Int. Cl.
*B41J 11/00* (2006.01)

(52) U.S. Cl.
CPC .... *B41J 11/00218* (2021.01); *B41J 11/00212* (2021.01); *B41J 11/00214* (2021.01)

(58) Field of Classification Search
CPC .... B41J 11/002; B41J 25/3088; B41J 2/2114; B41J 11/00214; B41J 11/00212; B41J 11/00218
See application file for complete search history.

(56) References Cited

U.S. PATENT DOCUMENTS

2004/0166249 A1 8/2004 Siegel
2011/0134179 A1 6/2011 Otsuka et al.
(Continued)

FOREIGN PATENT DOCUMENTS

CN 1980961 A 6/2007
CN 102099194 A 6/2011
(Continued)

OTHER PUBLICATIONS

International Search Report PCT/ISA/210 for International Application No. PCT/JP2019/012424, dated Jun. 3, 2019.
(Continued)

*Primary Examiner* — Bradley W Thies
(74) *Attorney, Agent, or Firm* — Harness, Dickey & Pierce, P.L.C.

(57) ABSTRACT

A liquid discharge apparatus includes a liquid discharge head, an irradiator, a carriage, and a conveyance controller. The liquid discharge head discharges liquid to a recording medium to form a liquid application surface. The irradiator emits active energy rays toward the liquid application surface. The carriage is mounted with the liquid discharge head and the irradiator. The conveyance controller conveys the carriage. The irradiator includes a first irradiator that is provided on one side surface of the carriage in a direction in which the carriage is conveyed and a second irradiator that is provided on another side surface of the carriage in the direction in which the carriage is conveyed. A position of the first irradiator and a position of the second irradiator in a direction perpendicular to the direction in which the carriage is conveyed, on irradiation of the active energy rays, are different from each other.

20 Claims, 10 Drawing Sheets

(56) References Cited

U.S. PATENT DOCUMENTS

| | | | | |
|---|---|---|---|---|
| 2012/0242737 | A1 | 9/2012 | Tanase et al. | |
| 2012/0249632 | A1* | 10/2012 | Usuda | B41J 11/00214 347/9 |
| 2013/0293609 | A1 | 11/2013 | Ohkawa | |
| 2016/0152043 | A1 | 6/2016 | Mezaki | |
| 2017/0001449 | A1 | 1/2017 | Takatsu et al. | |
| 2017/0072706 | A1* | 3/2017 | Okawa | B41J 2/01 |
| 2017/0080720 | A1 | 3/2017 | Mezaki | |
| 2018/0207956 | A1 | 7/2018 | Mezaki | |

FOREIGN PATENT DOCUMENTS

| | | | |
|---|---|---|---|
| CN | 102689509 | A | 9/2012 |
| CN | 102821960 | A | 12/2012 |
| CN | 103269861 | A | 8/2013 |
| CN | 103596762 | A | 2/2014 |
| CN | 105939854 | A | 9/2016 |
| JP | 2006-181805 | A | 7/2006 |
| JP | 2007-160728 | A | 6/2007 |
| JP | 2015-186918 | A | 10/2015 |
| WO | WO-2012053648 | A1 | 4/2012 |

OTHER PUBLICATIONS

Chinese Office Action dated Aug. 25, 2021.
"Application of Radiation Curing Technology in Automotive Coatings and Refinishing Coatings," Jan. 28, 2007.
Chinese Notice of Allowance dated Mar. 3, 2022.

* cited by examiner

LIQUID DISCHARGE APPARATUS HAVING INDIVIDUALLY CONTROLLED IRRADIATORS AND CONTROL METHOD

TECHNICAL FIELD

The present invention relates to a liquid discharge apparatus and a control method.

BACKGROUND ART

Conventionally, as an image forming apparatus, an inkjet recording apparatus which discharges ink from an inkjet head and forms an image on a recording medium has been known. Some inkjet recording apparatuses use ultraviolet (UV) curable inks. Specifically, the inkjet recording apparatus using the UV curable ink cures and fixes ink droplets attached on the recording medium by UV irradiation and forms an image. Furthermore, the inkjet recording apparatus using the UV curable ink applies a gloss coat using clear inks to add glossy feeling to the formed image.

PTL 1 (JP-2015-186918-A) discloses an inkjet printing apparatus that discharges clear ink to form an image after discharging colored ink on a recording medium through a plurality of passes and includes an irradiation means that is arranged relative to each head and irradiates the formed image with light. For example, in PTL 1, the irradiation means is controlled so that illuminance of light in the last pass for discharging the clear ink is set to be lower than the illuminance of the light irradiated in the previous pass, and the clear ink is uncured. Then, in PTL 1, another irradiation means is included at a position downstream side of a position where the head for discharging the clear ink is arranged, and the uncured clear ink is cured by using the another irradiation means having the lower illuminance.

CITATION LIST

Patent Literature

PTL 1: JP-2015-186918-A

SUMMARY OF INVENTION

Technical Problem

However, in the related art, a uniform irradiation amount of light is emitted at a position on the downstream side of the position where the head for discharging the clear ink is arranged. Therefore, there is a disadvantage in that it is difficult to adjust glossiness.

The present invention has been made in consideration of the above. An object of the present invention is to provide a liquid discharge apparatus and a control method capable of adjusting glossiness with high accuracy.

Solution to Problem

A liquid discharge apparatus includes a liquid discharge head, an irradiator, a carriage, and a conveyance controller. The liquid discharge head discharges liquid to a recording medium to form a liquid application surface. The irradiator emits active energy rays toward the liquid application surface. The carriage is mounted with the liquid discharge head and the irradiator. The conveyance controller conveys the carriage. The irradiator includes a first irradiator that is provided on one side surface of the carriage in a direction in which the carriage is conveyed and a second irradiator that is provided on another side surface of the carriage in the direction in which the carriage is conveyed. A position of the first irradiator and a position of the second irradiator in a direction perpendicular to the direction in which the carriage is conveyed, on irradiation of the active energy rays, are different from each other.

A liquid discharge apparatus includes a liquid discharge head, an irradiator, a carriage, and a conveyance controller. The liquid discharge head discharges liquid to a recording medium to form a liquid application surface. The irradiator emits active energy rays toward the liquid application surface. The carriage is mounted with the liquid discharge head and the irradiator. The conveyance controller conveys the recording medium. The irradiator includes a first irradiator that is provided on one side surface of the carriage in a direction perpendicular to a direction in which the recording medium is conveyed and a second irradiator that is provided on another side surface of the carriage in the direction perpendicular to the direction in which the recording medium is conveyed. A position of the first irradiator and a position of the second irradiator in the direction perpendicular to the direction in which the recording medium is conveyed, on irradiation of the active energy rays, are different from each other.

A control method is to be executed by a liquid discharge apparatus including a liquid discharge head to discharge liquid to a recording medium to form a liquid application surface, an irradiator that to emit active energy rays toward the liquid application surface, a carriage mounted with the liquid discharge head and the irradiator, and a conveyance controller to convey the carriage. The control method includes providing the irradiator including a first irradiator that is provided on one side surface of the carriage in a direction in which the carriage is conveyed and a second irradiator that is provided on another side surface of the carriage in the direction in which the carriage is conveyed; and controlling a position of the first irradiator and a position of the second irradiator in a direction perpendicular to the direction in which the carriage is conveyed by the conveyance controller to be different from each other and emitting the active energy rays.

Advantageous Effects of Invention

According to the present invention, an effect is obtained that glossiness can be adjusted with high accuracy.

BRIEF DESCRIPTION OF DRAWINGS

The accompanying drawings are intended to depict example embodiments of the present invention and should not be interpreted to limit the scope thereof. The accompanying drawings are not to be considered as drawn to scale unless explicitly noted. Also, identical or similar reference numerals designate identical or similar components throughout the several views.

DESCRIPTION OF EMBODIMENTS

Figure 1:
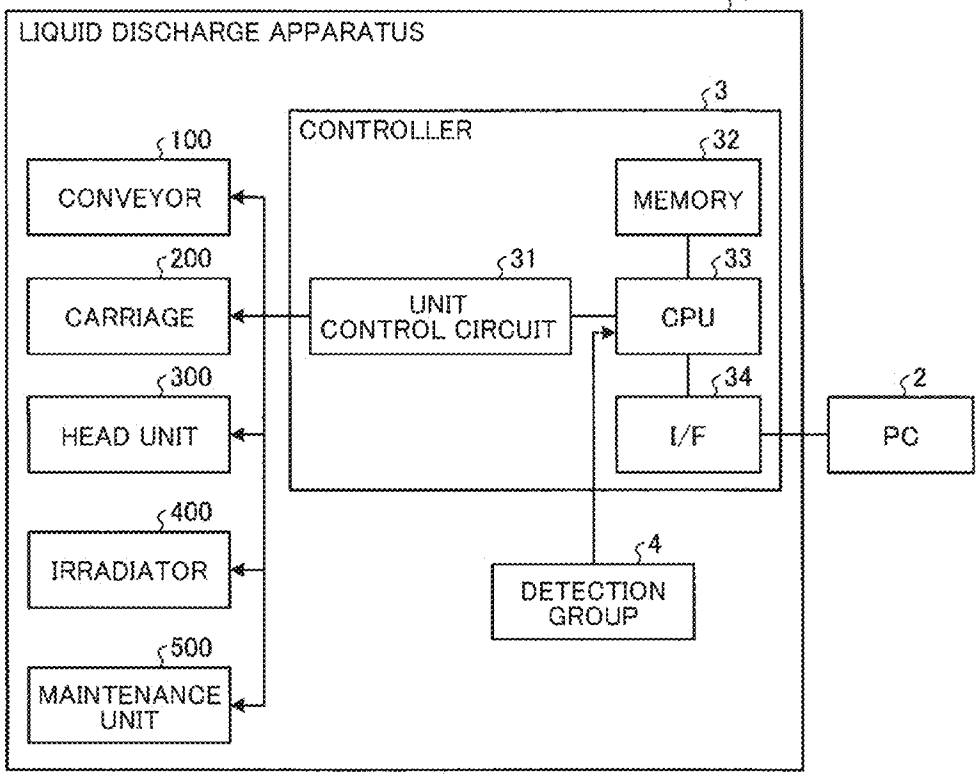
FIG. 1 is a hardware configuration diagram of a liquid discharge apparatus according to a first embodiment.

The terminology used herein is for the purpose of describing particular embodiments only and is not intended to be limiting of the present invention. As used herein, the singular forms "a", "an" and "the" are intended to include the plural forms as well, unless the context clearly indicates otherwise.

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Embodiments of a liquid discharge apparatus and a control method will be described with reference to the accompanying drawings below. The present invention is not limited to the following embodiments.

First Embodiment

Figure 2:
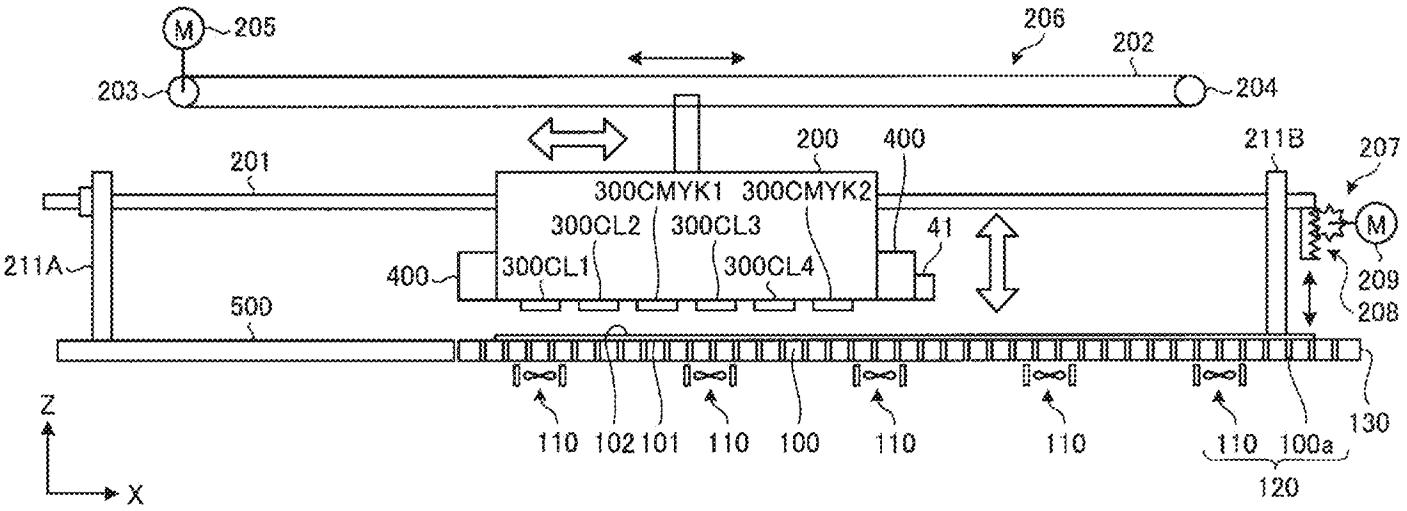
FIG. 2 is a front view of the liquid discharge apparatus according to the first embodiment.
Figure 3:
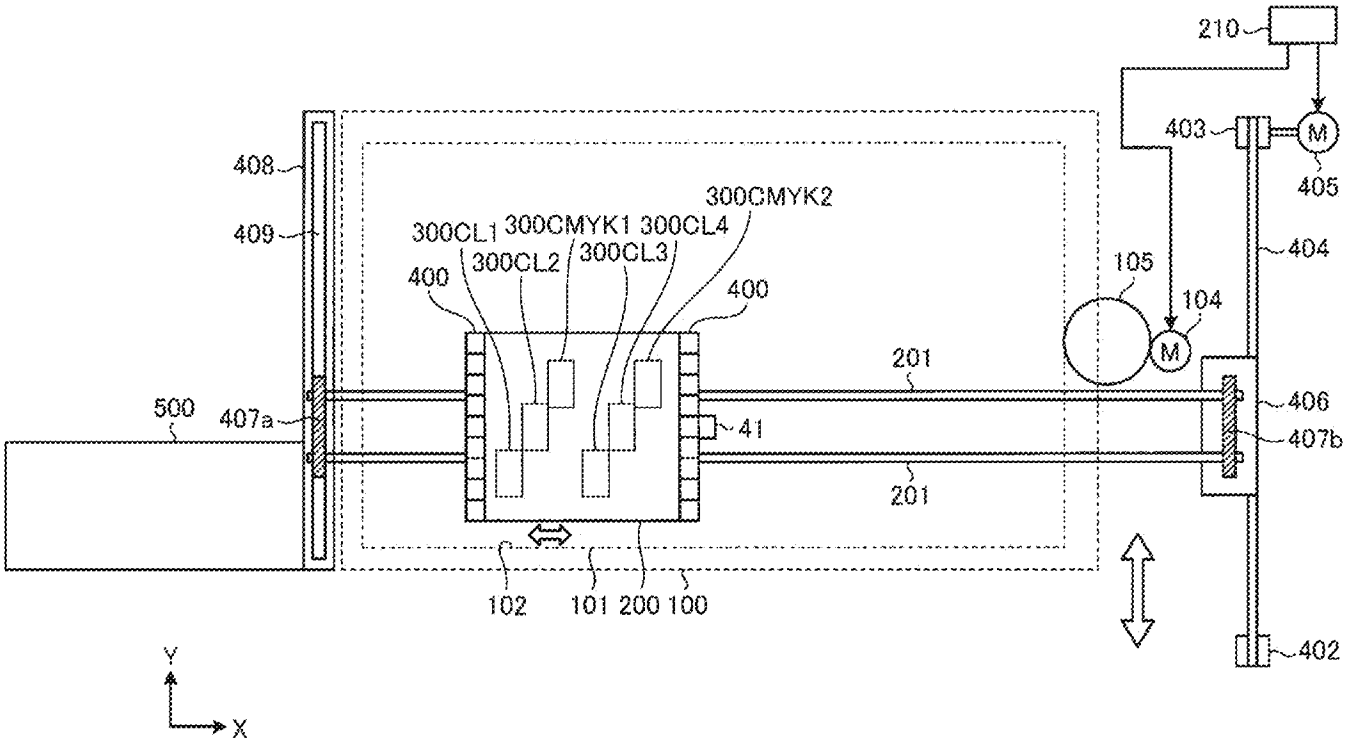
FIG. 3 is a bottom view of the liquid discharge apparatus according to the first embodiment.

FIG. 1 is a hardware configuration diagram of a liquid discharge apparatus 1 according to a first embodiment. FIG. 2 is a front view of the liquid discharge apparatus 1 according to the first embodiment. FIG. 3 is a bottom view of the liquid discharge apparatus 1 according to the first embodiment.

As illustrated in FIG. 1, the liquid discharge apparatus 1 includes a controller 3, a detection group 4, a conveyor 100, a carriage 200, a head unit 300, an irradiator 400, and a maintenance unit 500. The controller 3 includes a unit control circuit 31, a memory 32, a Central Processing Unit (CPU) 33, and an I/F 34.

The I/F 34 is an interface for connecting the liquid discharge apparatus 1 to an external Personal Computer (PC) 2. Any connection form between the liquid discharge apparatus 1 and the PC 2 may be used. For example, connection via a network, a form for directly connecting the liquid discharge apparatus 1 to the PC 2 with a communication cable, and the like are exemplified.

The detection group 4 includes various sensors included in the liquid discharge apparatus 1 such as a height sensor 41 illustrated in FIGS. 2 and 3 and the like.

The CPU 33 controls an operation of each unit of the liquid discharge apparatus 1 via the unit control circuit 31 using the memory 32 as a working area. Specifically, the CPU 33 controls the operation of each unit based on recording data received from the PC 2 and data detected by the detection group 4 and forms an image that is a liquid application surface 102 on a recording medium 101.

A printer driver is installed in the PC 2, and the printer driver generates the recording data to be transmitted to the liquid discharge apparatus 1 from image data. For example, the recording data includes command data which operates the conveyor 100 of the liquid discharge apparatus 1 and the like, pixel data regarding the image that is the liquid application surface 102, and the like.

The conveyor 100 includes a stage 130 and an attraction mechanism 120. The attraction mechanism 120 has a fan 110 and a plurality of attraction holes 100*a* provided in the stage 130. The attraction mechanism 120 drives the fan 110 and attracts the recording medium 101 from the attraction holes 100*a* to secure the recording medium 101 to the conveyor 100. The attraction mechanism 120 may attract the recording medium 101 by using electrostatic attraction. A movement of the conveyor 100 in the Y-axis direction (sub-scanning direction) is controlled based on a drive signal from the CPU 33 (unit control circuit 31).

As illustrated in FIG. 3, the conveyor 100 includes a conveyance controller 210, a roller 105, and a motor 104. The conveyance controller 210 drives the motor 104 and rotates the roller 105 to move the recording medium 101 in the Y-axis direction (sub-scanning direction).

Here, the conveyor 100 may move the carriage 200 in the Y-axis direction (sub-scanning direction) instead of the recording medium 101. That is, the conveyor 100 relatively moves the recording medium 101 and the carriage 200 in the Y-axis direction (sub-scanning direction). In the present embodiment, a case is exemplified where the carriage 200 is moved in the Y-axis direction.

For example, as illustrated in FIG. 3, the conveyor 100 includes a side plate 407*b* which supports two guides 201 for guiding the carriage 200 in the X-axis direction (main scanning direction), a table 406 which supports the side plate 407*b*, and a belt 404 which is secured to the table 406. Furthermore, the conveyor 100 includes a driving pulley 403 and a driven pulley to which the belt 404 is stretched, a motor 405 which rotates and drives the driving pulley 403, and the conveyance controller 210.

In addition, as illustrated in FIG. 3, the conveyor 100 includes a side plate 407*a* which supports the two guides 201 for guiding the carriage 200 in the X-axis direction (main scanning direction), a table 408 which slidably supports the side plate 407*a*, and a groove 409 which is formed in the table 408 and guides the side plate 407*a* in the sub-scanning direction.

The conveyor 100 drives the motor 405 by the conveyance controller 210 to rotate the driving pulley 403 and moves the belt 404 in the Y-axis direction (sub-scanning direction) two-dimensionally perpendicular to the X-axis direction (main scanning direction). By moving the table 406 which supports the carriage 200 in the Y-axis direction (sub-scanning direction) according to the movement of the belt 404, the carriage 200 can move in the Y-axis direction (sub-scanning direction). The side plate 407*a* moves in the Y-axis direction (sub-scanning direction) along the groove 409 in the table 408 along with the movement of the table 406 in the Y-axis direction (sub-scanning direction).

The head unit 300 includes liquid discharge heads 300CL1, 300CL2, 300CMYK1, 300CL3, 300CL4, and 300CMYK2 for respectively discharging UV curable inks such as clear (CL), cyan (C), magenta (M), yellow (Y), black (K), and the like (example of ultraviolet ray curable ink and active energy ray curable ink). Each head corresponds to a "liquid discharge head".

Each head includes piezo. When a drive signal is applied to the piezo by the CPU 33 (unit control circuit 31), the piezo contracts, and a change in a pressure due to the contraction makes the piezo discharge the UV curable ink on the recording medium 101. With this operation, the liquid application surface 102 is formed on the recording medium 101. The structure of each head of the head unit 300 is not limited to this. In the present embodiment, a case is exemplified where the clear (CL) ink discharged by the liquid discharge heads 300CL1 and 300CL3 forms a gloss coat.

The irradiator 400 is provided on the side surface (surface in X-axis direction) of the carriage 200 and emits UV light (example of active energy ray) based on the drive signal from the CPU 33 (unit control circuit 31). The irradiator 400 corresponds to an "irradiator". The irradiator 400 mainly includes a UV irradiation lamp (for example, Light Emitting Diode: LED) for emitting UV light.

The movement of the carriage 200 in the Z-axis direction (height direction) and the X-axis direction (main scanning direction) is controlled based on the drive signal from the CPU 33 (unit control circuit 31).

The carriage 200 scans and moves in the main scanning direction (X-axis direction) along the guides 201. A scanner 206 includes a driving pulley 203, a driven pulley 204, a driving belt 202, and a motor 205. The carriage 200 is secured to the driving belt 202 stretched between the driving pulley 203 and the driven pulley 204. The carriage 200 drives the driving belt 202 by the motor 205 to laterally scan and move in the main scanning direction.

The guide 201 is supported by side plates 211A and 211B of an apparatus body. A height adjuster 207 includes a motor 209 and a slider 208. A height adjuster 207 drives the motor 209 and vertically moves the slider 208 so as to vertically move the guides 201. The vertical movement of the guides 201 vertically moves the carriage 200, and a height of the carriage 200 relative to the recording medium 101 can be adjusted.

The maintenance unit 500 is a unit which cleans (maintain) each head of the head unit 300 which has been moved to the upper side of the maintenance unit 500 so as to maintain and recover a performance of each head of the head unit 300. Specifically, when liquid such as an arbitrary amount of ink is ejected from each head by a pressurizing mechanism, the maintenance unit 500 wipes the liquid such as the ink attached on the surface of each head by a wiper unit.

Here, an operation for forming the liquid application surface 102 by the liquid discharge apparatus 1 will be described.

The carriage 200 moves in the Y-axis direction (sub-scanning direction) based on the drive signal from the CPU 33 (unit control circuit 31) and moves to an initial position to form the liquid application surface 102 on the recording medium 101. In addition, the carriage 200 moves to a height suitable for discharge of the UV curable ink by the head unit 300 based on the drive signal from the CPU 33 (unit control circuit 31). The CPU 33 recognizes a height of the head unit 300 by detection of the height sensor 41.

Then, the carriage 200 reciprocates in the X-axis direction (main scanning direction=reciprocating direction) based on the drive signal from the CPU 33 (unit control circuit 31). At the time of the reciprocating movement, the head unit 300 discharges the UV curable ink based on the drive signal from the CPU 33 (unit control circuit 31). With this operation, the liquid application surface 102 for one scanning is formed on the recording medium 101. When the liquid application surface 102 for one scanning is formed on the recording medium 101, the carriage 200 moves for one scanning in the Y-axis direction (sub-scanning direction) which is a direction two-dimensionally perpendicular to the X-axis direction (main scanning direction) based on the drive signal from the CPU 33 (unit control circuit 31).

Thereafter, until the formation of the liquid application surface 102 is completed, the operation for moving the carriage 200 in the X-axis direction to form the liquid application surface 102 for one scanning and the operation for moving the carriage 200 in the Y-axis direction for one scanning are alternately performed.

Figure 4:
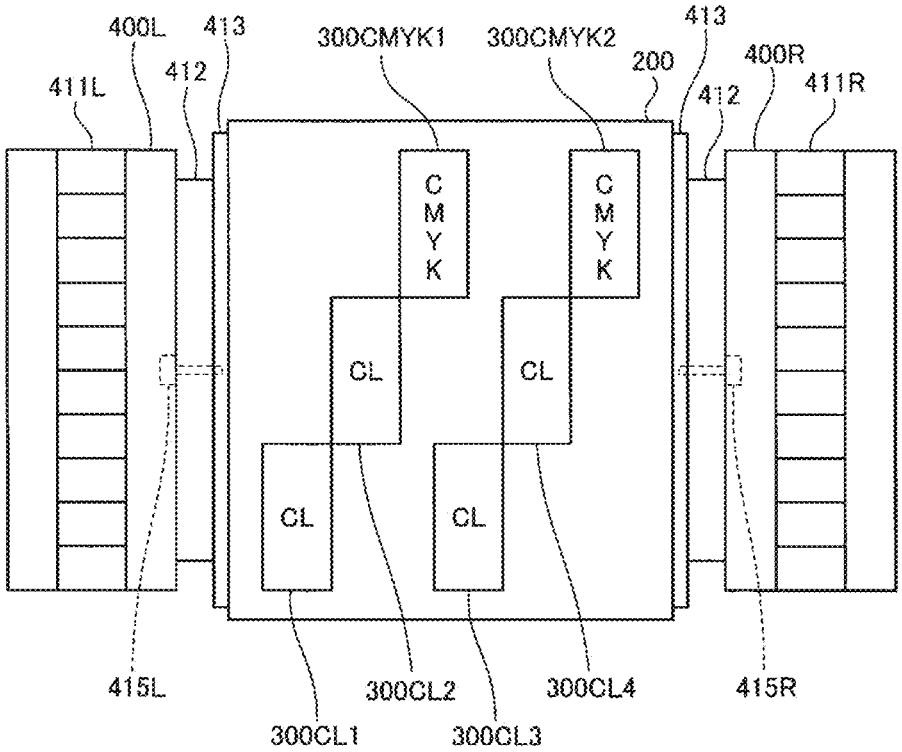
FIG. 4 is a diagram of an exemplary configuration of an irradiator provided on a side surface of a carriage of the liquid discharge apparatus according to the first embodiment.

FIG. 4 is a diagram of an exemplary configuration of the irradiator 400 provided on the side surface of the carriage 200 of the liquid discharge apparatus 1 according to the first embodiment.

As illustrated in FIG. 4, irradiators 400L and 400R are provided on the side surfaces perpendicular to the X-axis direction (main scanning direction) of the carriage 200. The irradiators 400L and 400R respectively correspond to a "first irradiator" and a "second irradiator". That is, the irradiator 400L is provided on one side surface of the carriage 200 in the main scanning direction to be movable in the sub-scanning direction and emits UV light toward the liquid application surface 102. In addition, the irradiator 400R is provided on another side surface of the carriage 200 in the main scanning direction to be movable in the sub-scanning direction and emits UV light toward the liquid application surface 102.

For example, each of the irradiators 400L and 400R is divided into a plurality of irradiation blocks. Each irradiation block can independently control an output of the UV irradiation lamp (irradiation and irradiation intensity at the time of irradiation). In FIG. 4, an example is illustrated in which each of irradiation blocks 411L and 411R is divided into ten irradiation blocks. The number of divisions of the irradiation block is not limited to this.

Each of the irradiators 400L and 400R is coupled to a lamp moving mechanism 412. The lamp moving mechanism 412 is coupled to a lamp securing mechanism 413 secured to the carriage 200. The irradiators 400L and 400R are secured to the lamp securing mechanism 413 by fitting lamp securing pins 415L and 415R into holes drilled in the lamp moving mechanism 412 and the lamp securing mechanism 413.

Furthermore, the lamp securing pin 415L (415R) is removed from the lamp moving mechanism 412 to release the securement of the irradiator 400L (400R) to the lamp securing mechanism 413. When the securement to the lamp securing mechanism 413 is released, the irradiator 400L (400R) can manually move in the sub-scanning direction. Then, when the irradiator 400L (400R) is moved to an arbitrary position in the sub-scanning direction, the irradiator 400L (400R) can be secured to the lamp securing mechanism 413 by the lamp securing pin 415L (415R). With this operation, the irradiator 400L (400R) can emit UV light toward the liquid application surface 102 on the recording medium 101 at the arbitrary position in the sub-scanning direction where the irradiator 400L (400R) is secured.

In the above, an example has been described in which the irradiator 400L (400R) is manually moved in the sub-scanning direction relative to the lamp securing mechanism 413. However, the present invention is not limited to this. That is, the lamp moving mechanism 412 may include an actuator for moving the irradiator 400L (400R) in the sub-scanning direction, and it is possible that the actuator is controlled so as to automatically move the irradiator 400L (400R) to an arbitrary position in the sub-scanning direction.

Figure 5:
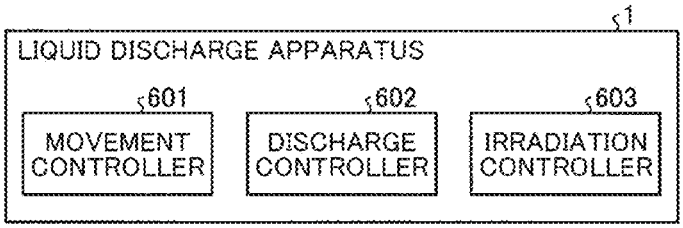
FIG. 5 is a functional block diagram of the liquid discharge apparatus according to the first embodiment.

FIG. 5 is a functional block diagram of the liquid discharge apparatus 1 according to the first embodiment.

The CPU 33 illustrated in FIG. 1 executes programs stored in the memory 32 to implement functions of a movement controller 601, a discharge controller 602, and an irradiation controller 603 illustrated in FIG. 5. In other words, the programs executed by the CPU 33 have a module configuration including the movement controller 601, the discharge controller 602, and the irradiation controller 603. The CPU 33 reads the programs from the memory 32 and develops and executes the movement controller 601, the discharge controller 602, and the irradiation controller 603 on a main storage device such as the memory 32.

The movement controller 601 controls the movement of the irradiator 400 in the sub-scanning direction. More specifically, the movement controller 601 controls the actuator included in the lamp moving mechanism 412 and moves the irradiators 400L and 400R in the sub-scanning direction. For example, a movement amount of each of the irradiators 400L and 400R in the sub-scanning direction (position of each irradiator 400) varies depending on a printing mode (method for forming liquid application surface 102). Furthermore, the movement amounts of the irradiators 400L and 400R in the sub-scanning direction (position of each irradiator 400) may be different from each other.

The discharge controller 602 controls the discharge of liquid such as ink by the head unit 300. More specifically, based on recording data generated by the PC 2 and the like, the discharge controller 602 controls discharge and drive of each head of the head unit 300 so as to discharge liquid such as ink in a pattern indicated by the recording data. In the present embodiment, an example will be described in which the liquid application surface 102 is formed as follows for each single line.

First, when the carriage 200 moves in the main scanning direction, the liquid discharge heads 300CMYK1 and 300CMYK2 discharge color (CMYK) ink. Subsequently, after the carriage 200 has moved in the sub-scanning direction, when the carriage 200 moves in the main scanning direction, the liquid discharge heads 300CL2 and 300CL4 discharge the clear (CL) ink. Subsequently, after the carriage 200 has moved in the sub-scanning direction, when the carriage 200 moves in the main scanning direction, the liquid discharge heads 300CL1 and 300CL3 discharge the clear (CL) ink. With these operations, one line of the liquid application surface 102 is formed.

The irradiation controller 603 controls the irradiation of UV light by the irradiator 400. More specifically, the irradiation controller 603 controls the irradiation (lighting) of UV light and the irradiation intensity at the time of the irradiation for each irradiation block of the irradiators 400L and 400R. For example, the irradiation intensity of each irradiation block varies depending on the printing mode (method for forming liquid application surface 102).

A part or all of the movement controller 601 to the irradiation controller 603 may be configured by hardware. The program executed by the CPU 33 is recorded to a computer-readable recording medium such as a Compact Disc Read Only Memory (CD-ROM), a flexible disk (FD), a CD-R, and a Digital Versatile Disk (DVD) in an installable or executable format file as one aspect and is provided. Alternatively, the program executed by the liquid discharge apparatus 1 may be provided by configuring the program to be stored in a computer connected to a network such as the Internet and downloaded via the network. Furthermore, the program executed by the liquid discharge apparatus 1 may be configured to be provided or distributed via the network such as the Internet. Furthermore, the program executed by the liquid discharge apparatus 1 may be configured to be provided by installed in a Read Only Memory (ROM) and the like in advance.

Figure 6:
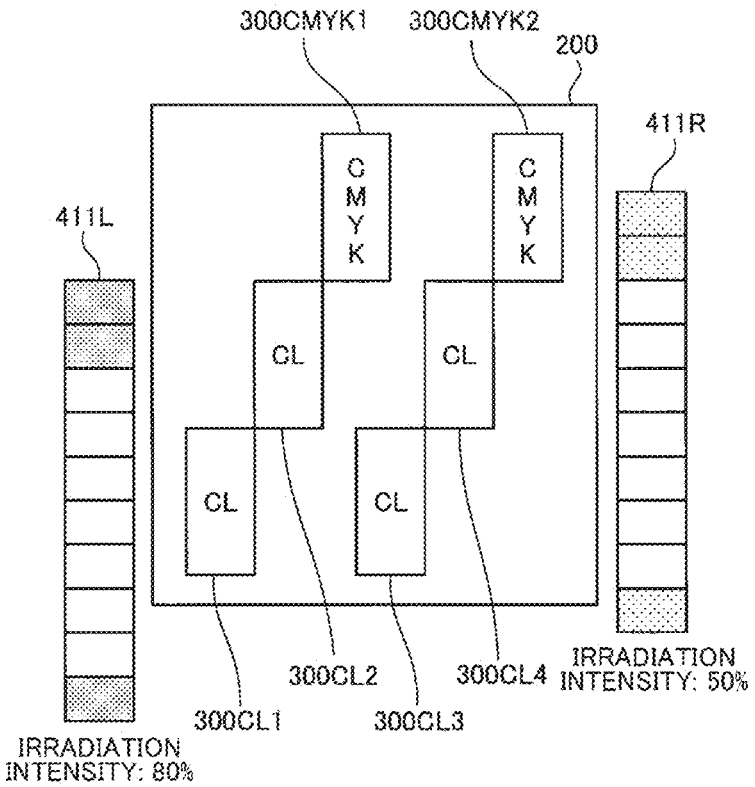
FIG. 6 is a diagram for explaining an example of control of a movement amount and an irradiation intensity of the irradiator provided on the liquid discharge apparatus according to the first embodiment.

FIG. 6 is a diagram for explaining an example of control of the movement amount and the irradiation intensity of the irradiator 400 of the liquid discharge apparatus 1 according to the first embodiment. In FIG. 6, a simple configuration of the irradiator 400 is illustrated. It is assumed that a sub-scanning moving direction of the carriage 200 be an upper side in FIG. 6. In other words, the upper side in FIG. 6 is a moving destination of the carriage 200 in the sub-scanning direction (downstream side), and the lower side in FIG. 6 is a moving source of the carriage 200 in the sub-scanning direction (upstream side).

For example, as illustrated in FIG. 6, the movement controller 601 moves the irradiator 400L to the upstream side for three irradiation blocks relative to the sub-scanning moving direction of the carriage 200 and moves the irradiator 400R to the upstream side for one irradiation block. The irradiation controller 603 lights a first, a second, and a tenth irradiation blocks 411L of the irradiator 400L and controls the irradiation intensity of the irradiation blocks 411L to 80 percent. The irradiation controller 603 lights a first, a second, and a tenth irradiation blocks 411R of the irradiator 400R and controls the irradiation intensity of the irradiation blocks 411R to 50 percent. As described above, the movement amount and the irradiation intensity of such an irradiator 400 are set according to the printing mode and the like. For example, in a case where a printing mode for offering a sense of matte is selected, the irradiation controller 603 controls the irradiation intensity to be the same as the conventional irradiation intensity, and in a case where a printing mode for offering glossy feeling is selected, the irradiation controller 603 moves the irradiator and changes the irradiation intensity to be different from the conventional irradiation intensity.

In the example illustrated in FIG. 6, the irradiation intensity of the irradiator 400 having a larger movement amount to the upstream side is controlled to be stronger. The movement amount and the irradiation intensity of the irradiator 400 illustrated in FIG. 6 are only exemplary, and the movement amount and the irradiation intensity of the irradiator 400 are not limited to the illustrated examples.

The liquid application surface 102 formed by the color (CMYK) ink discharged by the liquid discharge heads 300CMYK1 and 300CMYK2 is mainly cured by the UV light emitted from the first and the second irradiation blocks 411R of the irradiator 400R. The liquid application surface 102 formed by the clear (CL) ink discharged by the liquid discharge heads 300CL2 and 300CL4 is mainly cured by the UV light emitted from the first and the second irradiation blocks 411L of the irradiator 400L. The UV light is emitted immediately after the discharge of each ink.

The liquid application surface 102 formed by the clear (CL) ink discharged by the liquid discharge heads 300CL1 and 300CL3 is mainly cured by the UV light emitted from the tenth irradiation block 411R of the irradiator 400R and the tenth irradiation block 411L of the irradiator 400L. Here, each irradiator 400 is moved to the upstream side relative to the sub-scanning moving direction of the carriage 200. Therefore, the UV light is emitted after a lapse of time after the clear (CL) ink has been discharged by the liquid discharge heads 300CL1 and 300CL3. In addition, since the irradiation intensity of the irradiator 400R is controlled to 50 percent and the irradiation intensity of the irradiator 400L is controlled to 80 percent, the liquid application surface 102 formed by the clear (CL) ink discharged by the liquid discharge heads 300CL1 and 300CL3 can be gradually cured.

In other words, the irradiation controller 603 controls the irradiation intensity to be gradually increased relative to the liquid application surface 102 (example of predetermined liquid application surface) formed by the clear (CL) ink. Accordingly, the liquid discharge apparatus 1 can gradually cure the liquid application surface 102 formed by the clear (CL) ink, can prevent curing and shrinkage of the clear (CL) ink, and can reduce curing unevenness, and it is possible to adjust glossiness with high accuracy. Furthermore, since the liquid discharge apparatus 1 can secure a sufficient irradiation amount and can form a safe coating film so as to finally emit the UV light with the higher irradiation intensity to cure the clear (CL) ink.

Furthermore, another example of the control of the movement amount and the irradiation intensity of the irradiator 400 will be described.

Figure 7:
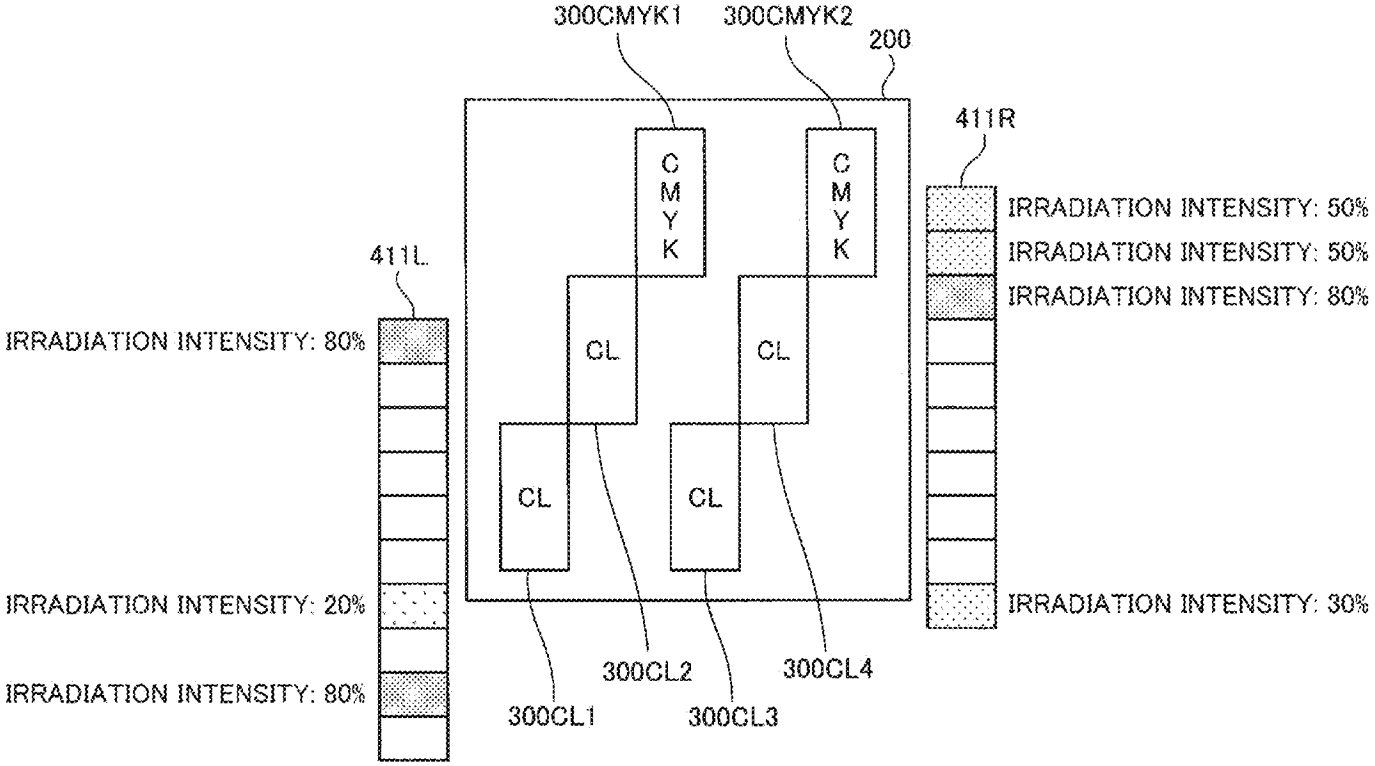
FIG. 7 is a diagram for explaining an example of control of the movement amount and the irradiation intensity of the irradiator provided on the liquid discharge apparatus according to the first embodiment.

FIG. 7 is a diagram for explaining an example of the control of the movement amount and the irradiation intensity of the irradiator 400 of the liquid discharge apparatus 1 according to the first embodiment. In FIG. 7, a simple configuration of the irradiator 400 is illustrated. As in FIG. 6, it is assumed that a sub-scanning moving direction of the carriage 200 be an upper side in FIG. 7.

For example, as illustrated in FIG. 7, the movement controller 601 moves the irradiator 400L to the upstream side for four irradiation blocks relative to the sub-scanning moving direction of the carriage 200 and moves the irradiator 400R to the upstream side for one irradiation block. The irradiation controller 603 lights the first and a ninth irradiation blocks 411L of the irradiator 400L and controls the irradiation intensity of the irradiation blocks 411L to 80 percent. The irradiation controller 603 lights a seventh irradiation block 411L of the irradiator 400L and controls the irradiation intensity of the irradiation block 411L to 20 percent.

The irradiation controller 603 lights the first and the second irradiation blocks 411R of the irradiator 400R and controls the irradiation intensity of the irradiation blocks 411R to 50 percent. The irradiation controller 603 lights a third irradiation block 411R of the irradiator 400R and controls the irradiation intensity of the irradiation block 411R to 80 percent. The irradiation controller 603 lights the tenth irradiation block 411R of the irradiator 400R and controls the irradiation intensity of the irradiation block 411R to 30 percent. The movement amount and the irradiation intensity of the irradiator 400 illustrated in FIG. 7 are only exemplary, and the movement amount and the irradiation intensity of the irradiator 400 are not limited to the illustrated examples.

The liquid application surface 102 formed by the color (CMYK) ink discharged by the liquid discharge heads 300CMYK1 and 300CMYK2 is mainly cured by the UV light emitted from the first and the second irradiation blocks 411R of the irradiator 400R. The liquid application surface 102 formed by the clear (CL) ink discharged by the liquid discharge heads 300CL2 and 300CL4 is mainly cured by the UV light emitted from the third irradiation block 411R of the irradiator 400R and the first irradiation block 411L of the irradiator 400L. The UV light is emitted immediately after the discharge of each ink.

Here, a difference from FIG. 6 will be described. In FIG. 7, the movement amount (position) of the irradiator 400L in the sub-scanning direction is different from that in FIG. 6. Accordingly, in FIG. 7, UV light is emitted to the liquid application surface 102 formed by the clear (CL) ink discharged by the liquid discharge heads 300CL2 and 300CL4 by the third irradiation block 411R of the irradiator 400R and the first irradiation block 411L of the irradiator 400L. In this way, even when the printing modes are the same, the movement amounts (position) of the right and left irradiator 400 are made different from each other so that there is no need to continuously use a specific irradiation block. With this configuration, deterioration of the UV irradiation lamp of the irradiator 400 caused by using only the specific irradiation block can be prevented.

As illustrated in FIG. 7, the liquid application surface 102 formed by the clear (CL) ink discharged by the liquid discharge heads 300CL1 and 300CL3 is mainly cured by the UV light emitted from the tenth irradiation block 411R of the irradiator 400R and the seventh and the ninth irradiation blocks 411L of the irradiator 400L. Here, each irradiator 400 is moved to the upstream side relative to the sub-scanning moving direction of the carriage 200. Therefore, the UV light is emitted after a lapse of time after the clear (CL) ink has been discharged by the liquid discharge heads 300CL1 and 300CL3.

In addition, the irradiation controller 603 controls the irradiation intensity of the tenth irradiation block 411R of the irradiator 400R to 30 percent and controls the irradiation intensity of the seventh irradiation block 411L of the irradiator 400L to 20 percent. In addition, the irradiation controller 603 controls the irradiation intensity of the ninth irradiation block 411L of the irradiator 400L to 80 percent. Therefore, the liquid application surface 102 formed by the clear (CL) ink discharged by the liquid discharge heads 300CL1 and 300CL3 can be gradually cured.

In other words, the irradiation controller 603 controls the irradiation intensity to be gradually increased relative to the liquid application surface 102 formed by the clear (CL) ink. Accordingly, the liquid discharge apparatus 1 can gradually cure the liquid application surface 102 formed by the clear (CL) ink, can prevent curing and shrinkage of the clear (CL) ink, and can reduce curing unevenness, and it is possible to adjust glossiness with high accuracy. Furthermore, since the liquid discharge apparatus 1 can secure a sufficient irradiation amount and can form a safe coating film so as to finally emit the UV light with the higher irradiation intensity to cure the clear (CL) ink.

Here, a difference from FIG. 6 will be described. In FIG. 7, UV light is emitted to the liquid application surface 102 formed by the clear (CL) ink discharged by the liquid discharge heads 300CL1 and 300CL3 by the tenth irradiation block 411R of the irradiator 400R and the seventh irradiation block 411L of the irradiator 400L. More specifically, the irradiation controller 603 controls the irradiation intensity of the tenth irradiation block 411R of the irradiator 400R to 30 percent and controls the irradiation intensity of the seventh irradiation block 411L of the irradiator 400L to 20 percent so as to achieve 50-percent irradiation intensity of the left and right irradiators in total. That is, the irradiation controller 603 performs control for distributing the 50-percent irradiation intensity into the left and right irradiators 400. With this configuration, the liquid discharge apparatus 1 can prevent the deterioration of the UV irradiation lamp of the irradiator 400 caused by using only the specific irradiation block.

Finally, UV light is emitted to the liquid application surface 102 formed by the clear (CL) ink discharged by the liquid discharge heads 300CL1 and 300CL3 by the ninth irradiation block 411L of the irradiator 400L. Specifically, the irradiation controller 603 controls the irradiation intensity of the ninth irradiation block 411L of the irradiator 400L to 80 percent. That is, in FIG. 7, the ninth irradiation block, instead of the tenth irradiation block (refer to FIG. 6), emits UV light with the irradiation intensity of 80 percent. With this configuration, the liquid discharge apparatus 1 can prevent the deterioration of the UV irradiation lamp of the irradiator 400 caused by using only the specific irradiation block.

As described above, the liquid discharge apparatus 1 includes the irradiator 400 which is provided on one or the other side in the main scanning direction in which the carriage 200 moves to be movable in the sub-scanning direction perpendicular to the main scanning direction and irradiates the liquid application surface 102 with the active energy ray. The liquid discharge apparatus 1 controls the irradiator 400 so as to gradually increase the irradiation intensity of UV light with respect to the liquid application surface 102 formed by the clear (CL) ink discharged by the head arranged on the upstream side relative to the sub-scanning moving direction of the carriage 200. As a result, the liquid discharge apparatus 1 can adjust the glossiness with high accuracy. The liquid discharge apparatus 1 can reduce an apparatus cost of the irradiator 400 in comparison with the related art in which a head for discharging the clear ink is arranged in addition to the irradiator arranged relative to each head.

Second Embodiment

Next, a liquid discharge apparatus according to a second embodiment will be described. The liquid discharge apparatus 1 according to the first embodiment has a configuration in which the irradiators 400 provided on the left and right side surfaces of the carriage 200 are moved along with the movement of the carriage 200. Whereas, the liquid discharge apparatus according to the second embodiment is an example in which irradiators 400 provided on left and right side surfaces of a carriage 200 can be independently driven. The first embodiment is different from the second embodiment to be described below only in this point. Therefore, only the difference will be described, and redundant description will be omitted.

Configuration and Operation of Second Embodiment

Figure 8:
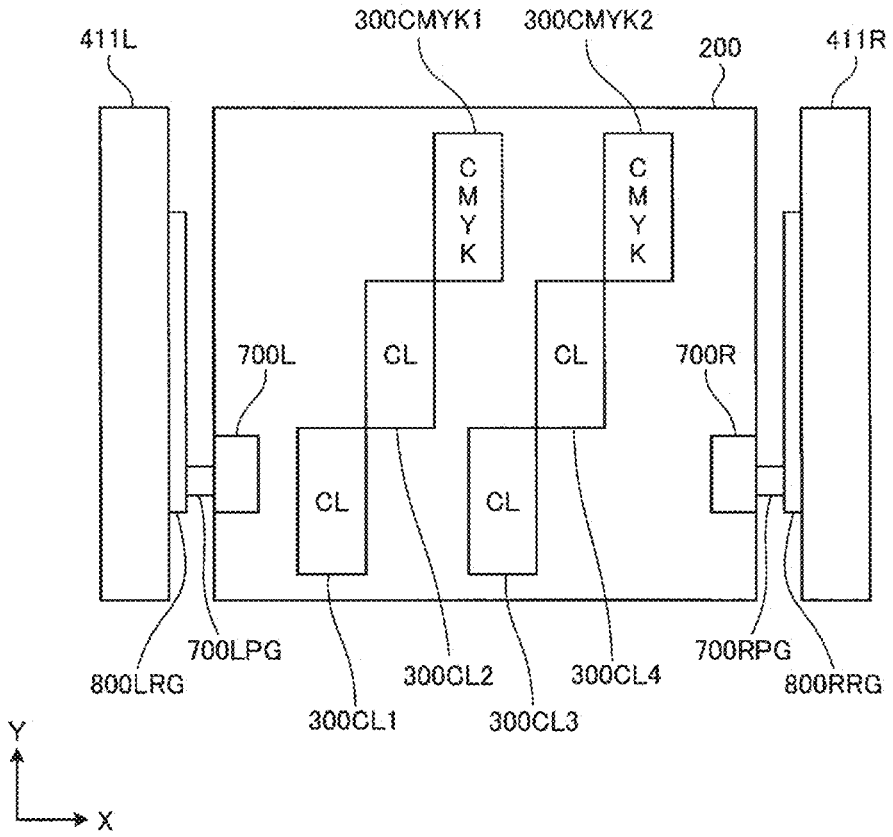
FIG. 8 is a top perspective view of main parts of a carriage and an irradiator of a liquid discharge apparatus according to a second embodiment.

FIG. 8 is a top perspective view of main parts of the carriage 200 of the liquid discharge apparatus according to the second embodiment. As illustrated in FIG. 8, in a case of the carriage 200 of the liquid discharge apparatus according to the second embodiment, an irradiation block 411L provided on the left side surface of the carriage 200 is provided to be movable along the Y-axis direction (sub-scanning direction) which is a conveying direction of the carriage 200 by a left motor 700L, a pinion gear 700LPG, and a rack gear 800LRG. Similarly, an irradiation block 411R provided on the right side surface of the carriage 200 is provided to be movable along the Y-axis direction (sub-scanning direction) which is the conveying direction of the carriage 200 by a right motor 700R, a pinion gear 700RPG, and a rack gear 800RRG.

Figure 9:
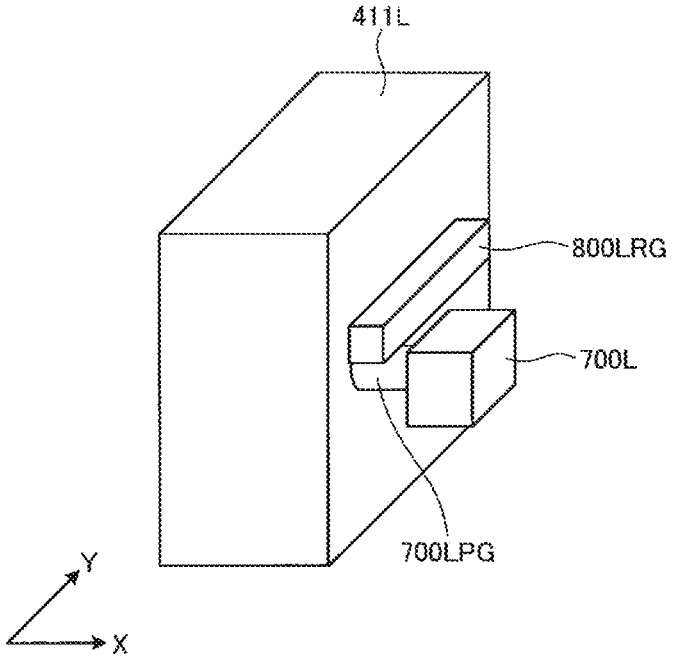
FIG. 9 is a perspective view of a coupling portion of an irradiation block relative to a left side surface of the carriage of the liquid discharge apparatus according to the second embodiment.

FIG. 9 is a perspective view of a coupling portion of the irradiation block 411L relative to the left side surface of the carriage 200. As illustrated in FIG. 9, the irradiation block 411L includes a prismatic rack gear 800LRG. When the irradiation block 411L is provided on the left side surface of the carriage 200, the prismatic rack gear 800LRG is secured and provided on an opposing surface of the irradiation block 411L which is a surface facing the carriage 200 so that the rack gear 800LRG is extended along the sub-scanning direction.

Figure 10:
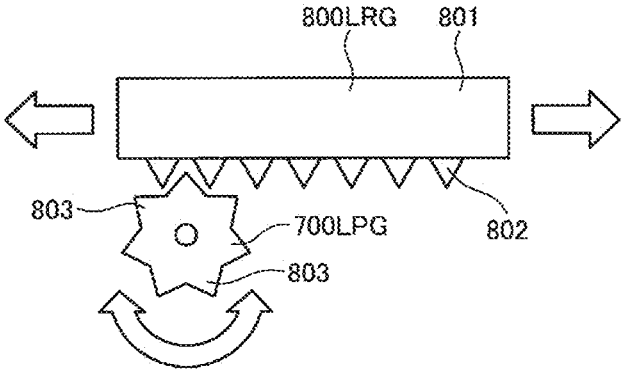
FIG. 10 is a diagram of a state where a rack gear and a pinion gear of the liquid discharge apparatus according to the second embodiment are engaged.

FIG. 10 is a diagram of a state where the rack gear 800LRG is engaged with the pinion gear 700LPG. As illustrated in FIG. 10, on a bottom surface of the rack gear 800LRG, convex gear portions 802 are continuously provided at predetermined intervals along the Y-axis direction (sub-scanning direction). The pinion gear 700LPG including convex gear portions 803 which are continuously provided at predetermined intervals along the outer periphery is provided on a rotation shaft of the left motor 700L provided on the carriage 200 side.

The gear portions 803 of the pinion gear 700LPG are engaged with the gear portions 802 of the rack gear 800LRG as illustrated in FIG. 10. Therefore, when the movement controller 601 illustrated in FIG. 5 rotates and controls the left motor 700L in a desired rotation direction, a rotation force of the left motor 700L is transmitted to the gear portion 802 of the rack gear 800LRG via the gear portion 803 of the pinion gear 700LPG. The gear portion 802 of the rack gear 800LRG converts the rotation force of the left motor 700L into a moving force in the sub-scanning direction. Then, the rotation force of the left motor 700L is transmitted to the irradiation block 411L as the moving force to the sub-scanning direction via the rack gear 800LRG. With this operation, as indicated by an arrow in FIG. 10, the irradiation block 411L can be moved and controlled along the sub-scanning direction according to the rotation direction of the left motor 700L.

The operations of the rack gear 800LRG and the pinion gear 700LPG of the irradiation block 411L have been described above. However, similarly, the rack gear 800RRG and the pinion gear 700RPG of the irradiation block 411R can move and control the irradiation block 411R along the sub-scanning direction by the movement controller 601. The movement controller 601 concurrently or independently moves and controls the irradiation blocks 411L and 411R.

Effects of Second Embodiment

As it is apparent from the above description, in the liquid discharge apparatus according to the second embodiment, the movement controller 601 can independently move and control the left and right irradiation blocks 411L and 411R via the left and right motors 700L and 700R provided on the left and right side surfaces of the carriage 200, the pinion gears 700LPG and 700RPG and the rack gears 800LRG and 800RRG. Therefore, glossiness can be adjusted with higher accuracy, and in addition, the effects similar to that in the first embodiment can be obtained.

Modification

Information including processing procedures, control procedures, specific names, various data and parameters described above and illustrated in the drawings can be arbitrarily changed unless otherwise noted. Furthermore, each component of the illustrated apparatus is functionally conceptual, and there is no need for each component to be physically configured as illustrated. That is, specific forms of distribution and integration of the apparatuses are not limited to those illustrated in the drawings. All or a part of the specific forms can be functionally or physically distributed or integrated in an arbitrary unit according to various loads and use conditions.

Furthermore, the liquid discharge apparatus 1 according to each embodiment includes the liquid discharge head or a liquid discharge unit and drives the liquid discharge head to make the liquid discharge head discharge liquid. The liquid discharge apparatus includes not only an apparatus which can discharge liquid to an object to which liquid can be attached but also an apparatus for discharging liquid toward air and liquid.

Furthermore, the liquid discharge apparatus 1 can include a device for feeding, conveying, and ejecting an object to which liquid can be attached, and in addition, can include a preprocessing device, a post-processing device, and the like.

Furthermore, the liquid discharge apparatus 1 is not limited to an apparatus which visualizes an image having meaning such as letters and figures by the discharged liquid. For example, an apparatus which forms a pattern having no meaning and an apparatus which forms a three-dimensional image are included.

The "object to which the liquid can be attached" means an object to which liquid can be temporarily attached, and includes an object to which liquid is attached and adhered, an object to which liquid is attached and permeated, and the like. Specific examples include recorded media such as a paper sheet, recording paper, a recording paper sheet, a film, and cloth, an electronic component such as an electronic substrate and a piezoelectric element, and media such as a powder layer, an organ model, and an inspection cell, and include all objects to which liquid can be attached unless otherwise limited.

The material of the "object to which liquid can be attached" may be paper, thread, fiber, cloth, leather, metal, plastic, glass, wood, ceramics, and the like to which liquid can be temporarily attached.

In addition, there is the liquid discharge apparatus 1 in which the liquid discharge head and the object to which liquid can be attached are relatively moved. However, the liquid discharge apparatus is not limited to this.

In addition, the liquid discharge apparatus 1 includes a processing liquid applying apparatus which discharges processing liquid to a paper sheet to apply the processing liquid on the surface of the paper sheet for the purpose of improving the quality of the surface of the paper sheet, an injection granulation apparatus which injects composition liquid obtained by dispersing a raw material into solution via a nozzle and granulates fine particles of the raw material, and the like.

The above embodiment is an example of the liquid discharge apparatus 1 which emits UV light from the irradiator 400 relative to the ultraviolet curable ink. However, the present invention can be applied to a liquid discharge apparatus which emits predetermined electron beams to electron curable ink, a liquid discharge apparatus which applies heat to thermal curable ink, or the like.

Finally, the embodiments are presented as an example, and it is not intended that the embodiments limit the scope of the present invention. This novel embodiment can be implemented in various other forms, and can be variously omitted, replaced, and changed without departing from the gist of the invention. In addition, the embodiments and the modification of the embodiments are included in the scope and the gist of the invention and also included in the invention described in the claims and the equivalent scope of the invention.

The present invention can be implemented in any convenient form, for example using dedicated hardware, or a mixture of dedicated hardware and software. The present invention may be implemented as computer software implemented by one or more networked processing apparatuses. The processing apparatuses can compromise any suitably programmed apparatuses such as a general purpose computer, personal digital assistant, mobile telephone (such as a WAP or 3G-compliant phone) and so on. Since the present invention can be implemented as software, each and every aspect of the present invention thus encompasses computer software implementable on a programmable device. The computer software can be provided to the programmable device using any conventional carrier medium (carrier means). The carrier medium can compromise a transient carrier medium such as an electrical, optical, microwave, acoustic or radio frequency signal carrying the computer code. An example of such a transient medium is a TCP/IP signal carrying computer code over an IP network, such as the Internet. The carrier medium can also comprise a storage medium for storing processor readable code such as a floppy disk, hard disk, CD ROM, magnetic tape device or solid state memory device.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

This patent application is based on and claims priority pursuant to 35 U.S.C. § 119(a) to Japanese Patent Application No. 2018-070224, filed on Mar. 30, 2018, and No. 2019-017354, filed on Feb. 1, 2019, in the Japan Patent Office, the entire disclosure of which is hereby incorporated by reference herein.

The invention claimed is:

1. A liquid discharge apparatus comprising:

a liquid discharge head to discharge liquid to a recording medium to form a liquid application surface;

an irradiator to emit active energy rays toward the liquid application surface;

a carriage mounted with the liquid discharge head and the irradiator and to move in a main scanning direction, the liquid discharge head discharging liquid while the carriage moves in the main scanning direction;

a conveyance controller to convey the carriage in a sub scanning direction perpendicular to the main scanning direction; and a moving mechanism to move the irradiator relative to the liquid discharge head in the sub scanning direction, wherein the irradiator includes a first irradiator provided on one side surface of the carriage in the main scanning direction, and a second irradiator provided on another side surface of the carriage in the main scanning direction, and wherein a position of the first irradiator and a position of the second irradiator, in the sub scanning direction, upon irradiation of the active energy rays, are different from each other.

2. The liquid discharge apparatus of claim 1, further comprising:

an irradiation controller to control the irradiation of the active energy rays by the irradiator, wherein the first irradiator and the second irradiator are each respectively divided into a plurality of irradiation blocks, and wherein the irradiation controller is configured to control an irradiation intensity of the active energy rays for each of the plurality of irradiation blocks.

3. The liquid discharge apparatus of claim 2, wherein the irradiation controller is configured to control the irradiation intensity for each of the plurality of irradiation blocks so that the irradiation intensity gradually increases toward a downstream side in the sub scanning direction.

4. The liquid discharge apparatus of claim 3, wherein the irradiation controller is configured to control the irradiation intensity for each of the plurality of irradiation blocks so that irradiation intensities set for the respective irradiation blocks, of the plurality of irradiation blocks, are distributed to the first irradiator and the second irradiator.

5. The liquid discharge apparatus of claim 2, wherein the irradiation controller is configured to control the irradiation intensity for each of the plurality of irradiation blocks so that irradiation intensities set for the respective irradiation blocks, of the plurality of irradiation blocks, are distributed to the first irradiator and the second irradiator.

6. The liquid discharge apparatus of claim 2, wherein irradiation intensities of the first irradiator and the second irradiator are different from each other depending on a method for forming the liquid application surface.

7. The liquid discharge apparatus of claim 1, wherein the position of the first irradiator and the position of the second irradiator, in the direction in which the carriage, is conveyed by the conveyance controller, on the irradiation of the active energy rays, are different depending on a method for forming the liquid application surface.

8. The liquid discharge apparatus of claim 1, further comprising a movement controller to control movement of the first irradiator and movement of the second irradiator, with respect to the direction in which the carriage is conveyed by the conveyance controller.

9. The liquid discharge apparatus of claim 1 wherein the moving mechanism moves the first irradiator and the second irradiator separately.

10. The liquid discharge apparatus of claim 1, wherein the irradiator is manually moved relative to the liquid discharge head in the sub scanning direction.

11. The liquid discharge apparatus of claim 1, wherein the liquid discharge head includes a color liquid discharge head to discharge color liquid and a clear liquid discharge head to discharge clear liquid, the first irradiator includes a first irradiation part provided at a position where the color liquid discharge head is provided in the sub scanning direction and a second irradiation part provided at a position where the color liquid discharge head and the clear liquid discharge head are not provided in the sub-scanning direction, and the second irradiator includes a third irradiation part provided at a position where the clear liquid discharge head is provided in the sub scanning direction and a fourth irradiation part provided at a position where the color liquid discharge head and the clear liquid discharge head are not provided in the sub-scanning direction.

12. A liquid discharge apparatus comprising:

a liquid discharge head to discharge liquid to a recording medium to form a liquid application surface;

an irradiator to emit active energy rays toward the liquid application surface;

a carriage mounted with the liquid discharge head and the irradiator and to move in a main scanning direction, the liquid discharge head discharging liquid while the carriage moves in the main scanning direction;

a conveyance controller to convey the recording medium in a sub scanning direction perpendicular to the main scanning direction; and a moving mechanism to move the irradiator relative to the liquid discharge head in the sub scanning direction, wherein the irradiator includes a first irradiator provided on one side surface of the carriage in the man scanning direction and a second irradiator provided on another side surface of the carriage in the main scanning direction, and wherein a position of the first irradiator and a position of the second irradiator, in the main scanning, upon irradiation of the active energy rays, are different from each other.

13. The liquid discharge apparatus of claim 12, further comprising:

an irradiation controller to control the irradiation of the active energy rays by the irradiator, wherein the first irradiator and the second irradiator are each respectively divided into a plurality of irradiation blocks, and wherein the irradiation controller is configured to control an irradiation intensity of the active energy rays for each of the plurality of irradiation blocks of each of the first irradiator and the second irradiator.

14. The liquid discharge apparatus of claim 13, wherein the irradiation controller is configured to control the irradiation intensity for each of the plurality of irradiation blocks so that the irradiation intensity gradually increases toward a downstream side in the sub scanning direction.

15. The liquid discharge apparatus of claim 12, wherein the position of the first irradiator and the position of the second irradiator, in the direction in which the recording medium, is conveyed by the conveyance controller, on the irradiation of the active energy rays, are different depending on a method for forming the liquid application surface.

16. The liquid discharge apparatus of claim 12, further comprising a movement controller to control movement of the first irradiator and movement of the second irradiator, with respect to the direction in which the recording medium is conveyed by the conveyance controller.

17. The liquid discharge apparatus of claim 12, wherein the moving mechanism moves the first irradiator and the second irradiator separately.

18. The liquid discharge apparatus of claim 12, wherein the irradiator is manually moved relative to the liquid discharge head in the sub scanning direction.

19. The liquid discharge apparatus of claim 12, wherein the liquid discharge head includes a color liquid discharge head to discharge color liquid and a clear liquid discharge head to discharge clear liquid, the first irradiator includes a first irradiation part provided at a position where the color liquid discharge head is provided in the sub scanning direction and a second irradiation part provided at a position where the color liquid discharge head and the clear liquid discharge head are not provided in the sub scanning direction, and the second irradiator includes a third irradiation part provided at a position where the clear liquid discharge head is provided in the sub-scanning direction and a fourth irradiation part provided at a position where the color liquid discharge head and the clear liquid discharge head are not provided in the sub-scanning direction.

20. A control method to be executed by a liquid discharge apparatus including a liquid discharge head to discharge liquid to a recording medium to form a liquid application surface, an irradiator to emit active energy rays toward the liquid application surface, a carriage mounted with the liquid discharge head and the irradiator and to move in a main scanning direction, the liquid discharge head discharging liquid while the carriage moves in the main scanning direction, and a conveyance controller to convey the carriage in a sub scanning direction perpendicular to the main scanning direction, and a moving mechanism to move the irradiator relative to the liquid discharge head in the sub scanning direction, the control method comprising:

providing the irradiator including a first irradiator, provided on one side surface of the carriage in the main scanning direction, and a second irradiator, provided on another side surface of the carriage in the main scanning direction; and controlling a position of the first irradiator and controlling a position of the second irradiator, in the main scanning direction, to be different from each other upon emitting the active energy rays.

* * * * *